US007316370B2

(12) United States Patent
Sankovic et al.

(10) Patent No.: US 7,316,370 B2
(45) Date of Patent: Jan. 8, 2008

(54) MISSILE FIN LOCKING METHOD AND ASSEMBLY

(75) Inventors: John Sankovic, Chesterland, OH (US); James Byrne, Williston, VT (US); Daniel Piltz, Newton Falls, OH (US)

(73) Assignee: Goodrich Corporation, Charlotte, NC (US)

( * ) Notice: Subject to any disclaimer, the term of this patent is extended or adjusted under 35 U.S.C. 154(b) by 28 days.

(21) Appl. No.: 11/150,897

(22) Filed: Jun. 13, 2005

(65) Prior Publication Data

US 2006/0278754 A1 Dec. 14, 2006

(51) Int. Cl.
*F42B 10/14* (2006.01)

(52) U.S. Cl. ..... 244/3.27

(58) Field of Classification Search ..... 244/3.24–3.3, 244/49, 75.1, 224
See application file for complete search history.

(56) References Cited

U.S. PATENT DOCUMENTS

| | | | | |
|---|---|---|---|---|
| 5,409,185 A * | 4/1995 | Oldakowski | ..... | 244/75.1 |
| 5,551,793 A * | 9/1996 | Lewis | ..... | 244/3.25 |
| 5,950,963 A * | 9/1999 | Speicher et al. | ..... | 244/3.21 |
| 6,073,880 A * | 6/2000 | Voigt et al. | ..... | 244/3.28 |
| 6,250,584 B1 * | 6/2001 | Hsu et al. | ..... | 244/3.24 |

* cited by examiner

*Primary Examiner*—Timothy D. Collins
(74) *Attorney, Agent, or Firm*—Kathleen K. Bowen

(57) ABSTRACT

A fin locking mechanism for locking in place, and subsequently unlocking fins for installation on a missile having a plurality of otherwise moveable fins. Where the fins are mounted to a crank arm, there is a locking detent, with a locking notch, integral to the crank arm. A spring loaded locking plunger has an end which fits into the locking notch. The locking plungers are mounted into the assembly housing locking plunger channels. A base plate is spaced from the locking detent such that when one end of the locking plunger is fitted into the locking notch, the other end of the locking plunger is slidably pressed against the base plate by the spring loading, and the locking plunger is relatively perpendicular to the base plate. The base plate also has a plurality of locking plunger recesses, wherein when one end of the locking plunger resides in the locking plunger recesses, the other end of the locking plunger will not reach the locking notch and therefore the fins will be unlocked. A support plate is mounted to the assembly housing, and the base plate is rotateably mounted to the support plate. A rotational loading mechanism rotationally loads the base plate to force the base plate to rotate relative to the support plate to a position where the fins are unlocked. A rotational lock locks the base plate in a rotationally loaded position by extending into a rotational lock recess on the base plate. Thus, when the fins are locked, an end of the locking plunger is slidably pressed on the base plate, and when the rotational lock is released, the base plate rotates and the locking plunger slides over it until the locking plungers recesses are moved under the locking plungers, wherein the locking plungers are forced into the locking plunger recesses by the spring loading, thus moving the other end of the locking plunger out of the locking notch, unlocking the fins.

25 Claims, 9 Drawing Sheets

MISSILE FIN LOCKING METHOD AND ASSEMBLY

BACKGROUND

The present invention is in the field of missile fin control. More specifically this invention relates to an apparatus and method for locking and unlocking missile control fins.

Flight control systems for a missile generally comprise fins which are moveable and controllable during flight. When these missiles are carried on the exterior of an aircraft, the missile, and thus the fins, are subjected to high aerodynamic loading. This loading can cause the fins to move and flutter, which in turn puts loads on the fin control mechanism, potentially causing failure or fatigue. Any fatigue or failure may result in the missile not being controlled accurately enough to reach its target.

Prior methods have provided locks to keep the fins from moving prior to launch. Most of these methods call for the locking of the fins by insertion of some type of locking mechanism into the fin, and removal of this mechanism before launching. For example, U.S. Pat. No. 6,352,217 provides for a slot in each fin wherein a locking pin is inserted into this slot. This pin is then connected by a linkage to a slide mechanism. There is a striker which is activated to strike this slide member, thus initiating movement, which in turn hopefully will move the linkage, which in turn will retract the locking pin. This is typical of the prior art which has complicated mechanism which depend on each other working to produce the desired result and which must initiate positive movement to unlock the missile fins. The more complicated the mechanism, the more chances there are for error. Further, having to initiate positive movement requires overcoming inertia, which is another chance for an error or malfunction. A missile fin locking mechanism is desired which would not require such complicated mechanism, and which would not require the initiation of positive movement to unlock the fins.

Prior locking methods such as the one described above, do not allow for testing of the mechanism after installation. Typically the missile is assembled in the "fin-locked" position, and is maintained that way until the missile is fired. A fin locking method and apparatus is desired which would allowed the missile to be assembled, the fins locked, the unlocking of the fins tested, and then the fins re-locked.

Further, prior fin-locking mechanisms have been assembled with the assembly of the missile. This process is time consuming and often complicated. A fin locking apparatus is desired which could be pre-assembled, and then placed into a missile during assembly, this would reduce the time, complexity, and cost of this process.

SUMMARY OF THE INVENTION

A fin locking mechanism for locking in place, and subsequently unlocking fins for installation on a missile having a plurality of otherwise moveable fins. Where the fins are mounted to a crank arm, there is a locking detent, with a locking notch, integral to said crank arm. A spring loaded locking plunger has an end of a size and shape to fit into the locking notch. An assembly housing has locking plunger channels to fit the locking plungers, such that both ends of the locking plungers extend out of the locking plunger channels. A base plate is spaced from the locking detent such that when one end of the locking plunger is fitted into the locking notch, the other end of the locking plunger is slidably pressed against the base plate by the spring loading, and the locking plunger is relatively perpendicular to the base plate. The base plate also has a plurality of locking plunger recesses, wherein when one end of the locking plunger resides in the locking plunger recesses, the other end of the locking plunger will not reach the locking notch and therefore the fins will be unlocked. A support plate is mounted to the assembly housing, and the base plate is rotateably mounted to the support plate. A rotational loading mechanism rotationally loads the base plate to force the base plate to rotate relative to the support plate to a position where the fins are unlocked. A rotational lock locks the base plate in a rotationally loaded position by extending into a rotational lock recess on the base plate. Thus, when the fins are locked, an end of the locking plunger is slidably pressed on the base plate, and when the rotational lock is released, the base plate rotates and the locking plunger slides over it until the locking plungers recesses are moved under the locking plungers, wherein the locking plungers are forced into the locking plunger recesses by the spring loading, thus moving the other end of the locking plunger out of the locking notch, unlocking the fins.

DETAILED DESCRIPTION

Figure 1:
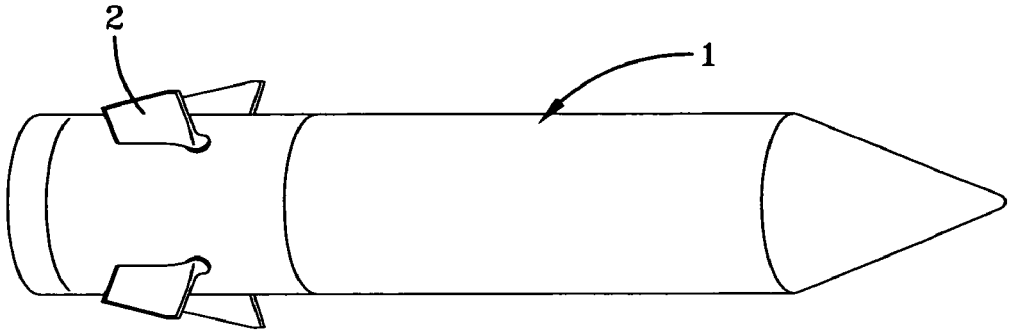
FIG. 1 is an isometric view of a missile.
Figure 2:
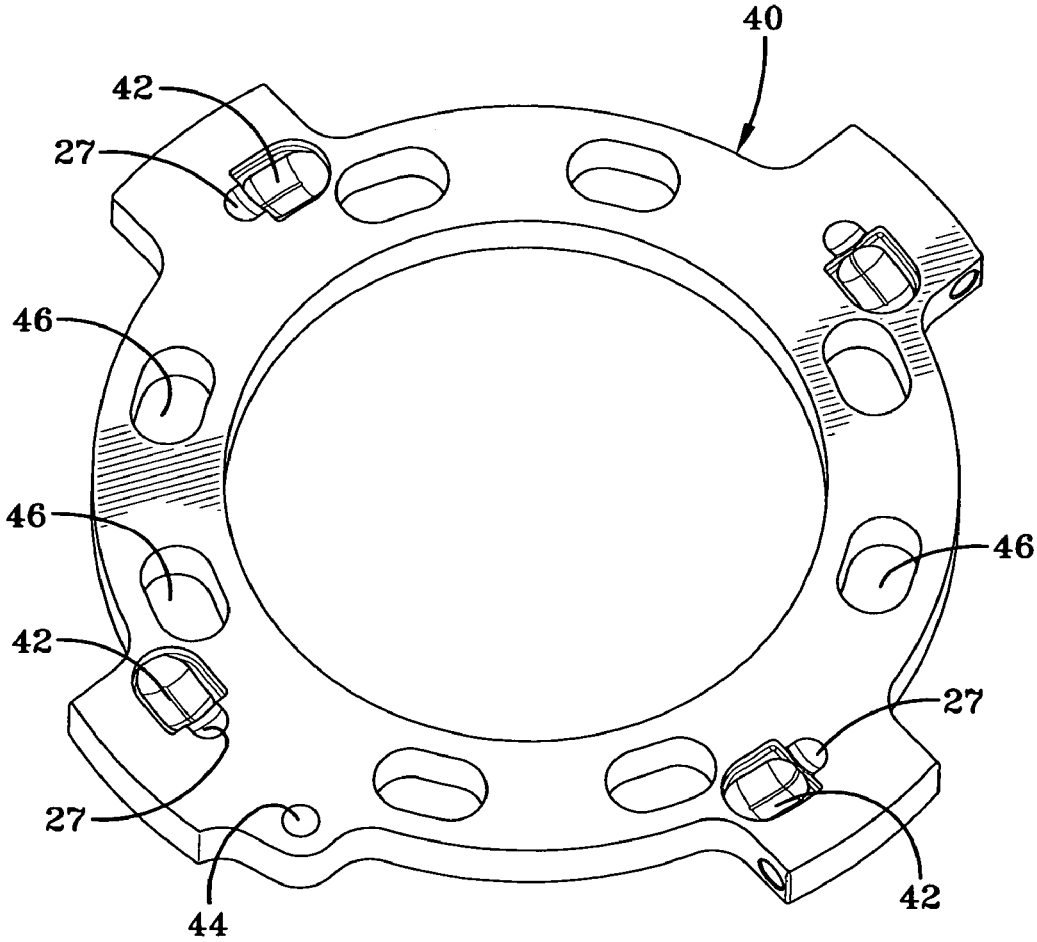
FIG. 2 is an isometric top view of a base plate, according to an aspect of the invention.
Figure 3:
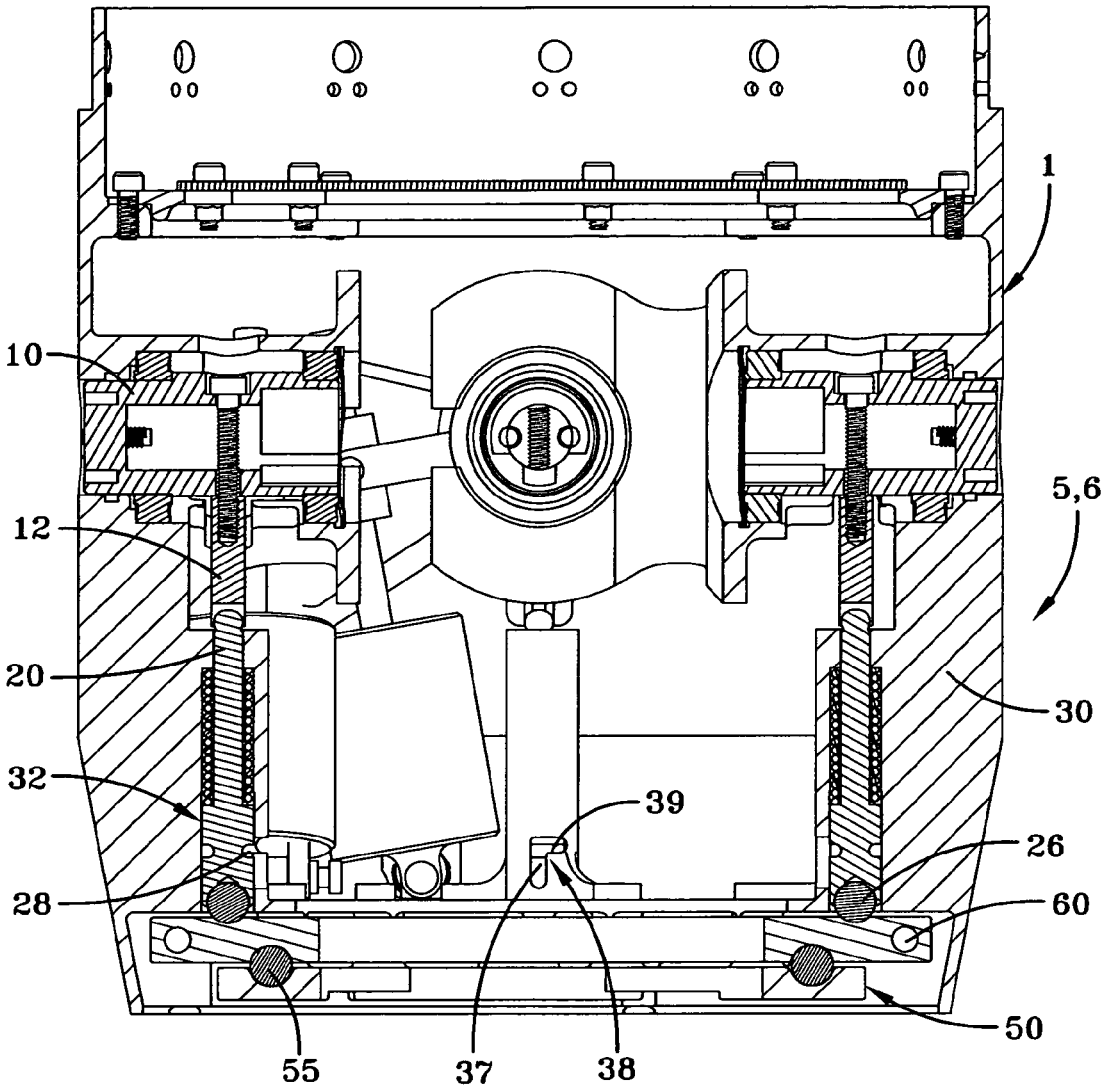
FIG. 3 is a cross-sectional view of a fin locking assembly, according to an aspect of the invention.
Figure 4:
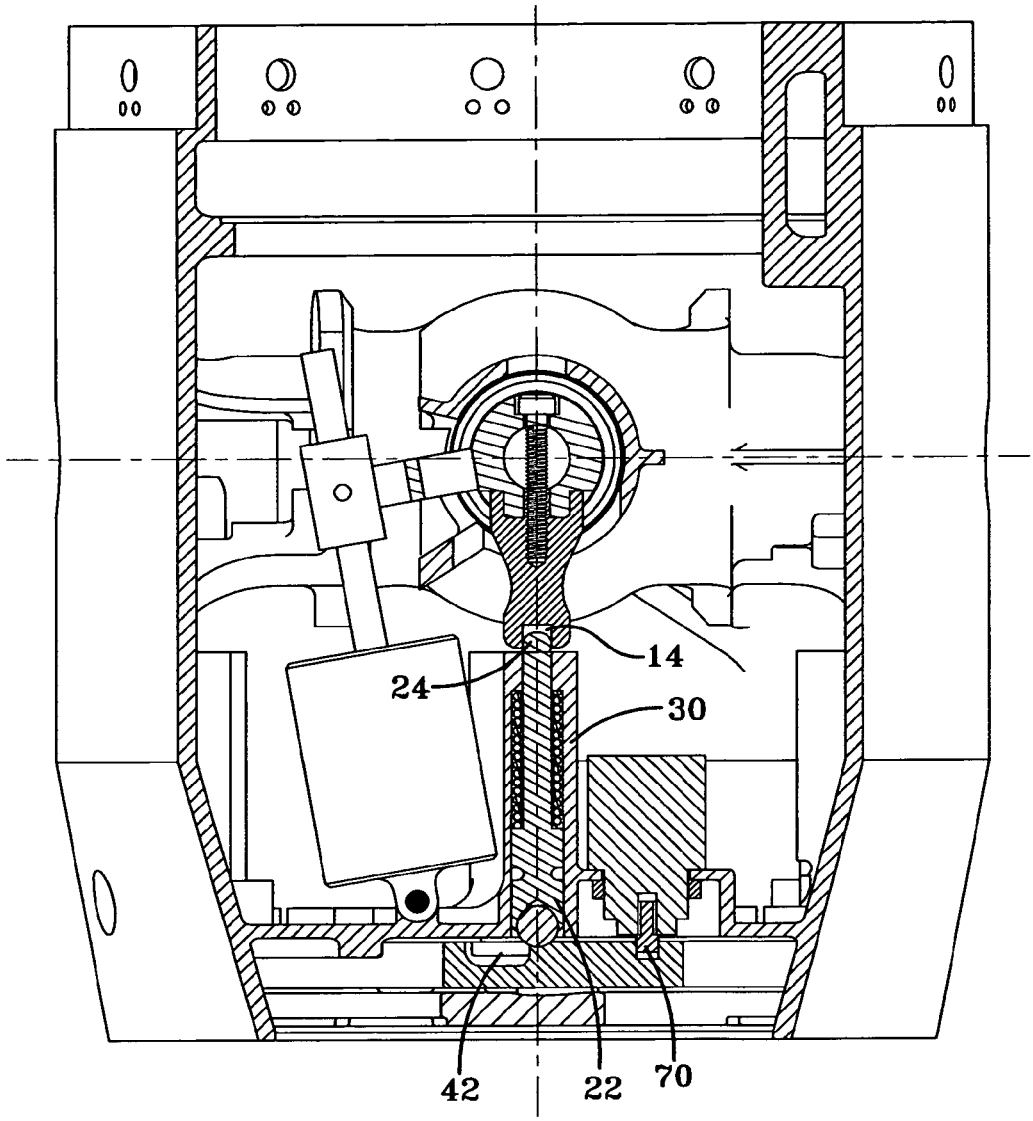
FIG. 4 is a cross-sectional view of a fin locking assembly, according to an aspect of the invention.
Figure 5:
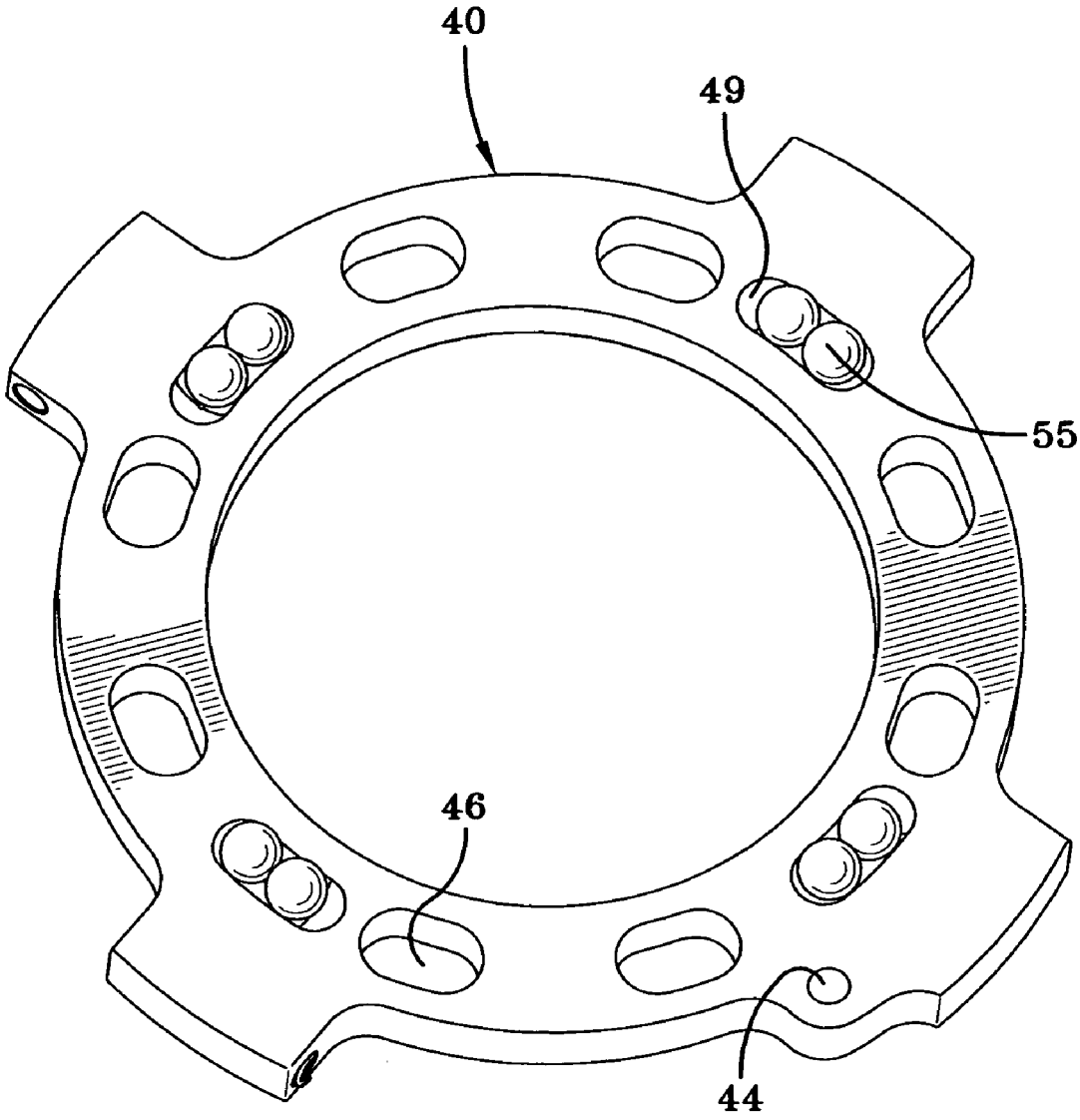
FIG. 5 is an isometric bottom view of a base plate, according to an aspect of the invention.
Figure 6:
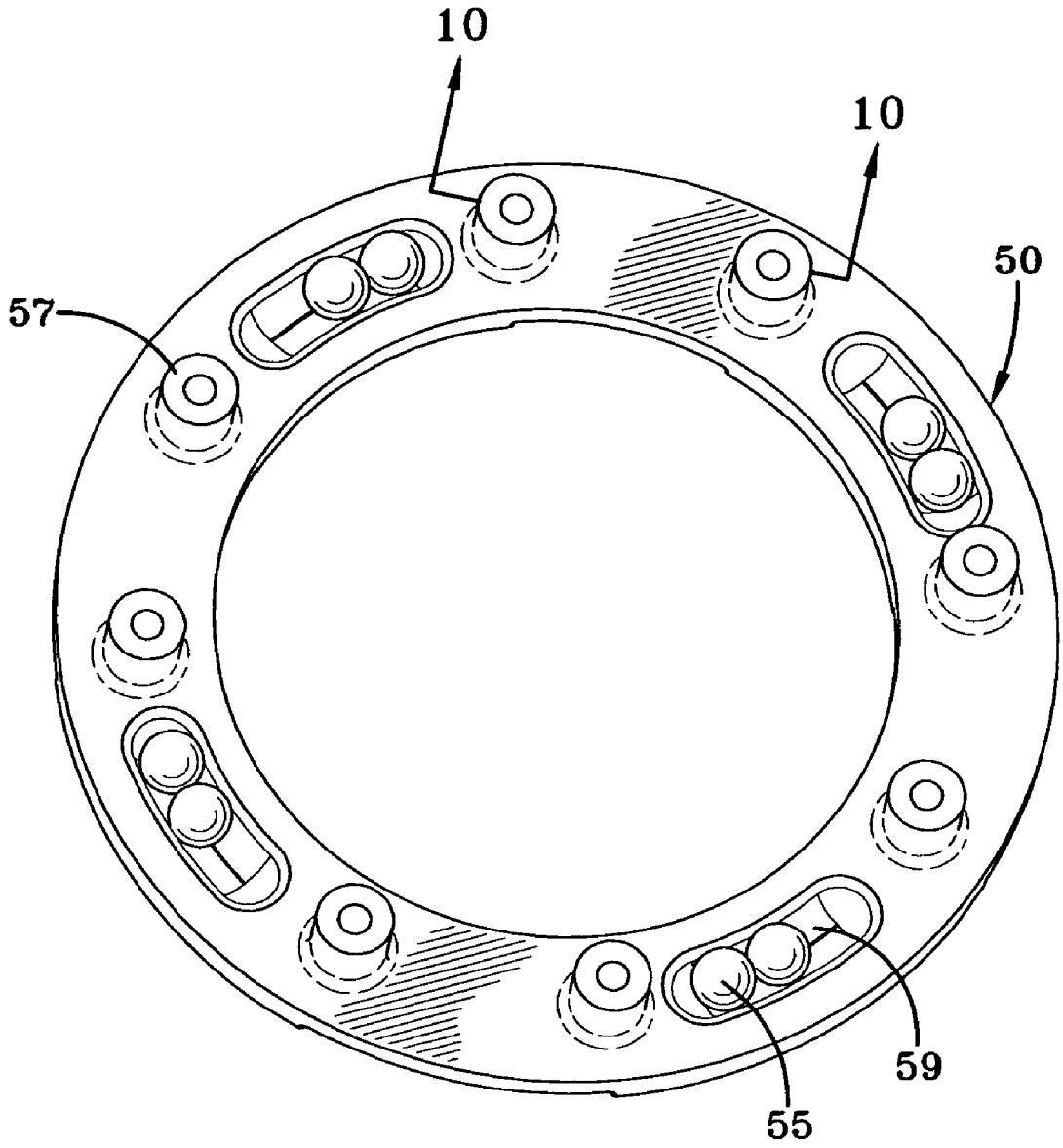
FIG. 6 is a top view of a support plate, according to an aspect of the invention.
Figure 7:
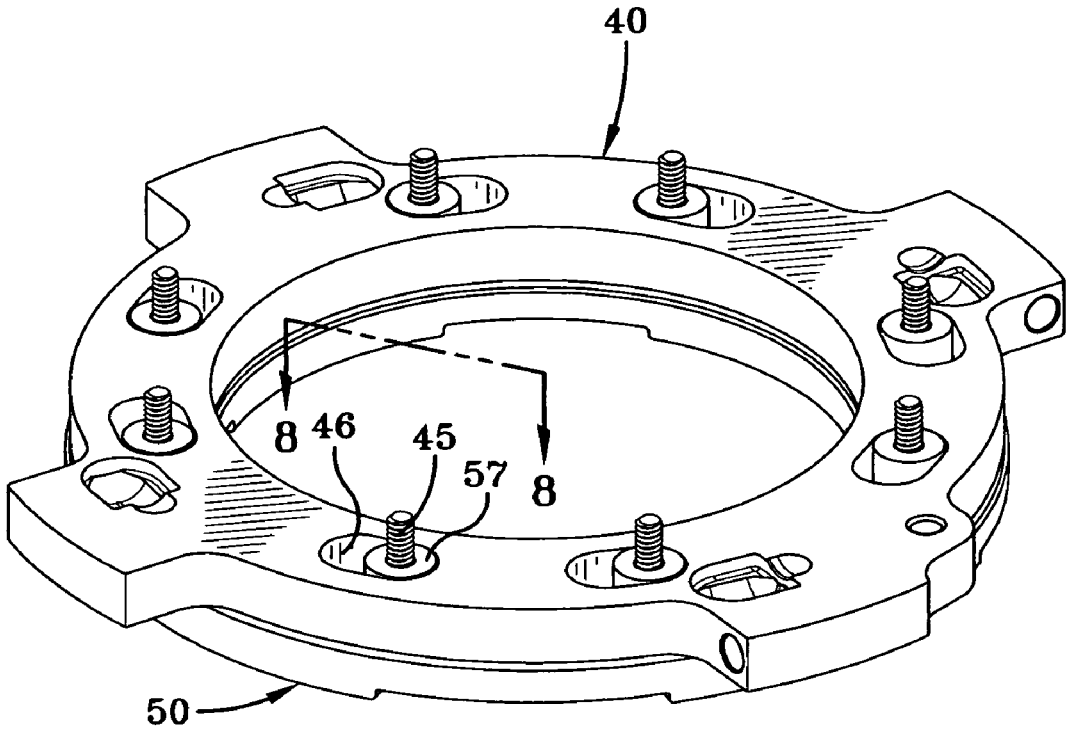
FIG. 7 is an isometric view of a base plate mounted to a support plate, according to an aspect of the invention.
Figure 8:
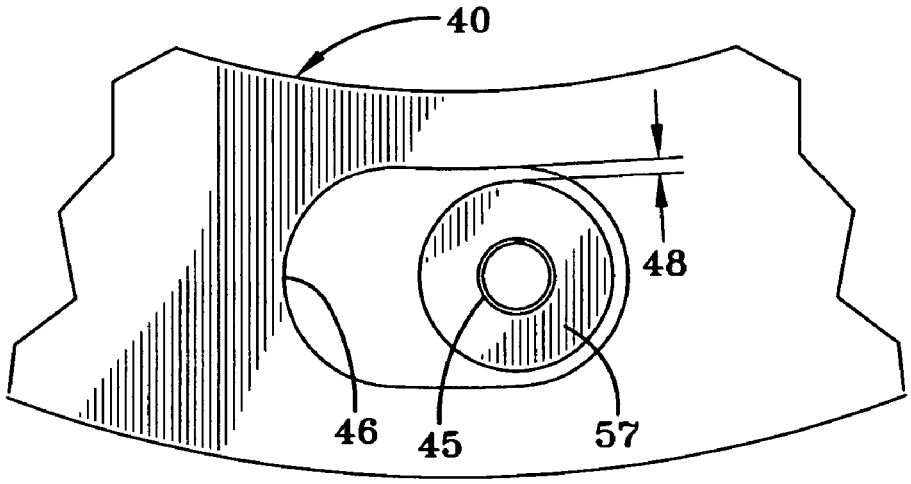
FIG. 8 is a cross-sectional view of a base plate from FIG. 7, according to an aspect of the invention.
Figure 9:
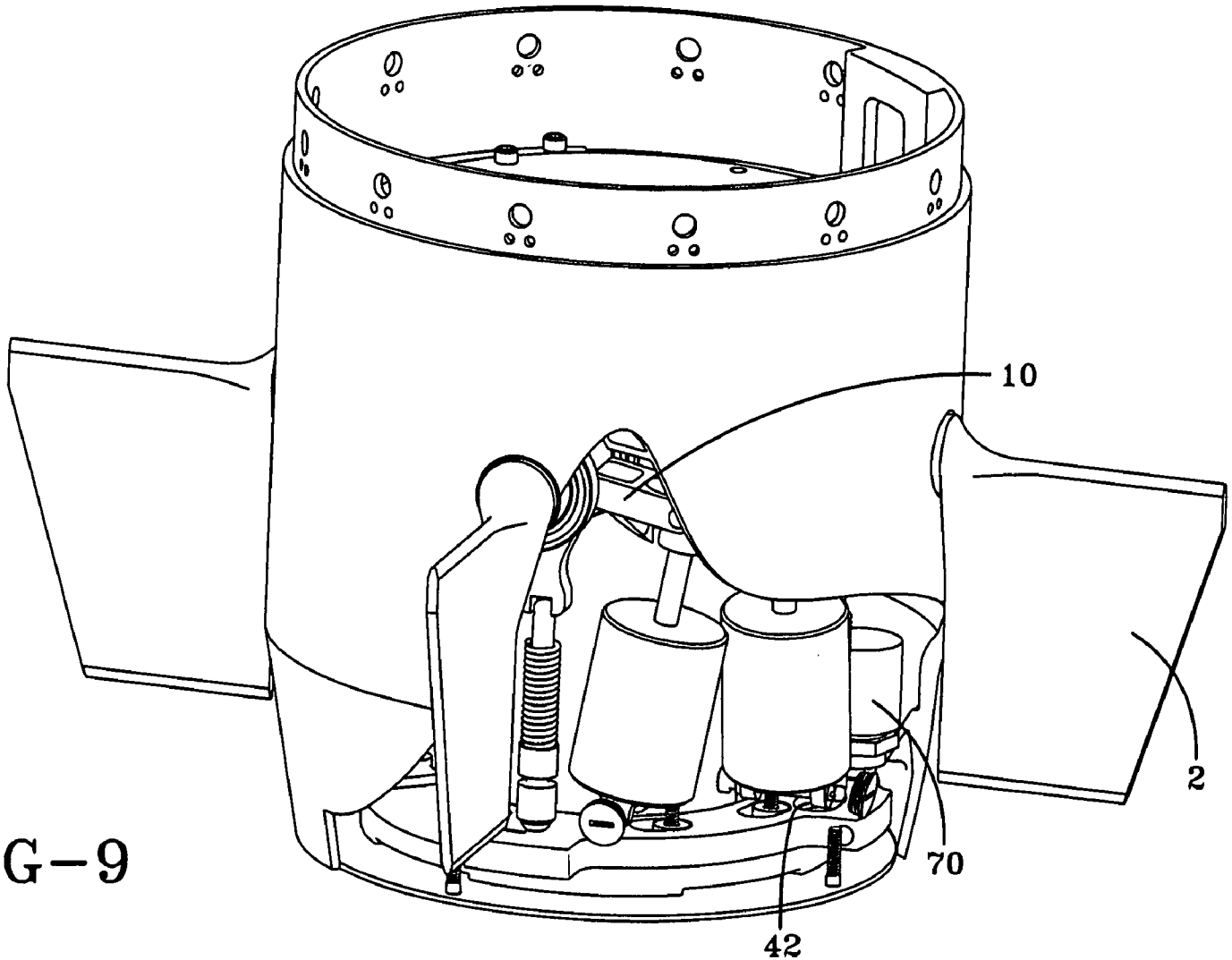
FIG. 9 is an assembly view of a fin control section, with cut-away, according to an aspect of the invention.
Figure 10:
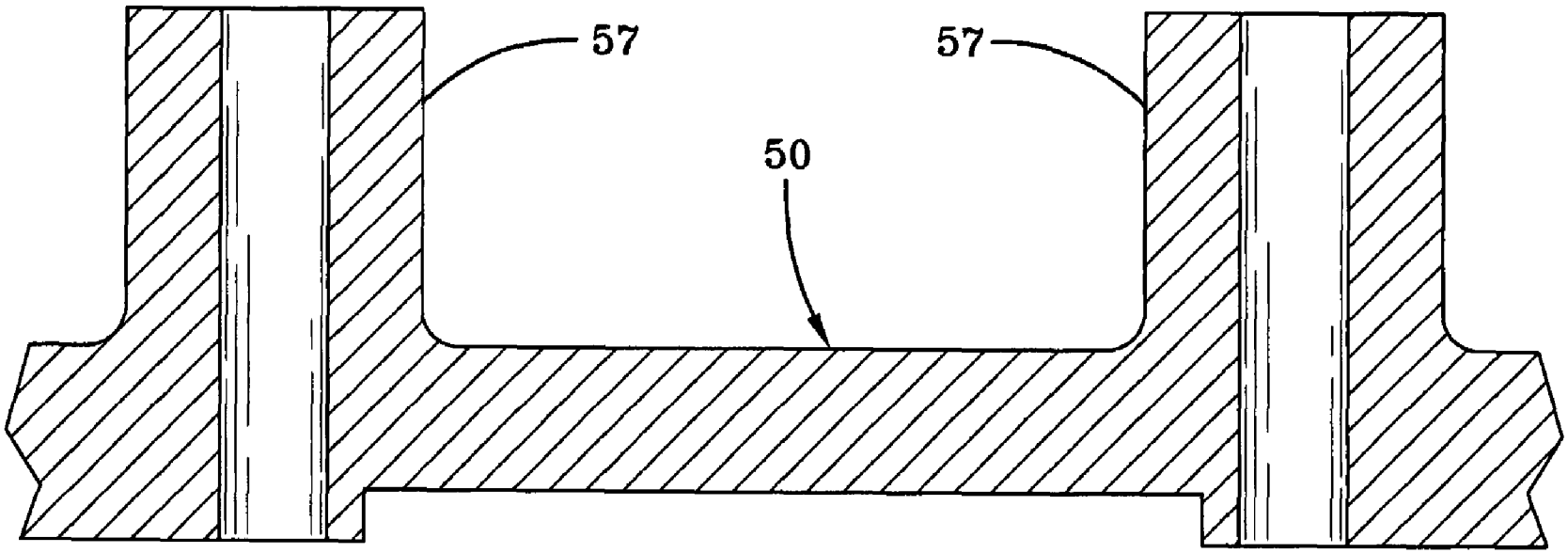
FIG. 10 is a cross-sectional view of a support plate from FIG. 6, according to an aspect of the invention.
Figure 11:
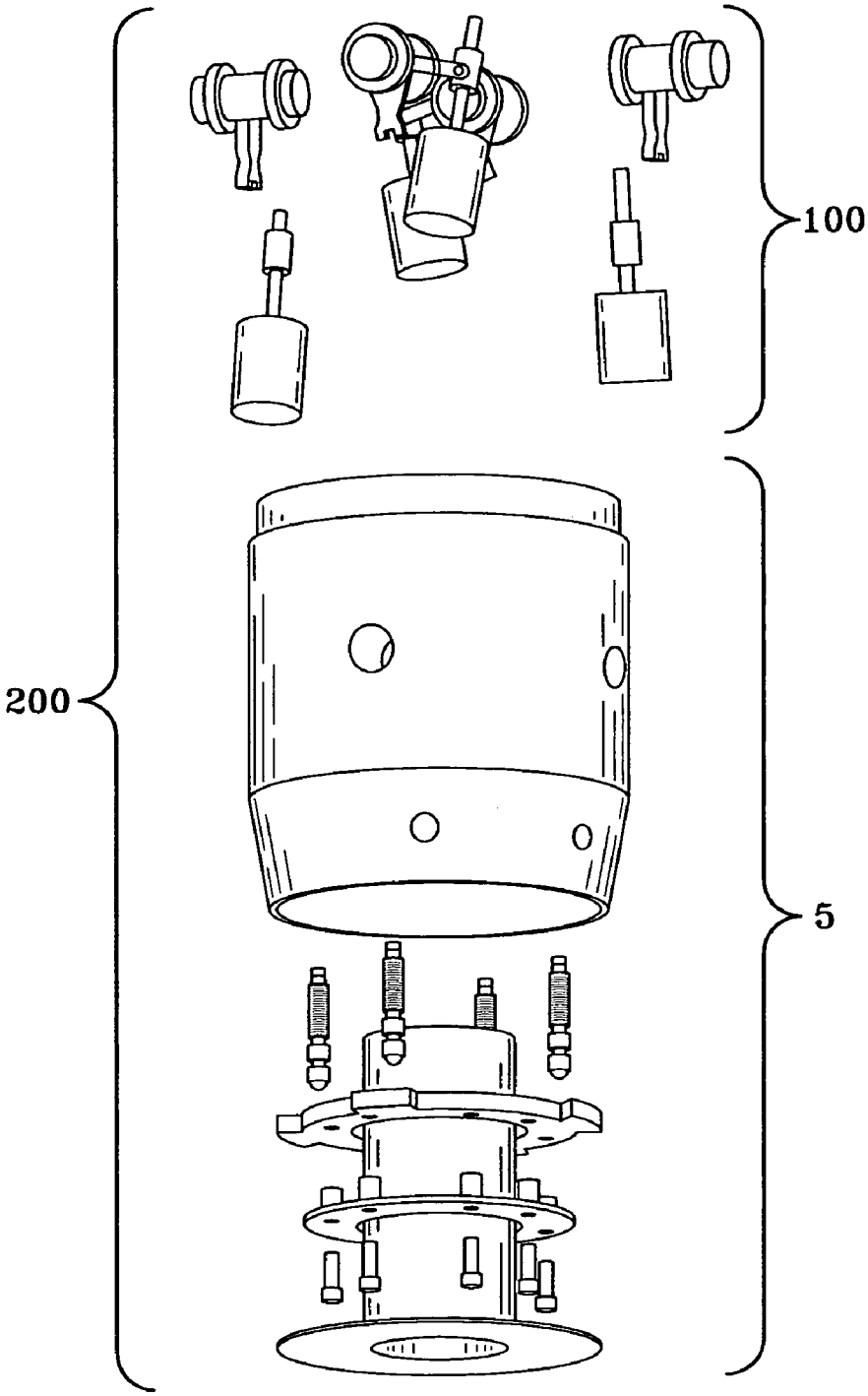
FIG. 11 is an exploded view of a fin control section, according to an aspect of the invention.

Various aspects of the invention are presented in FIGS. 1-10 which are not drawn to scale and in which like components are numbered alike.

A missile 1 typically has fins 2 for control surfaces. To lock these fins 2 in place against aerodynamic forces before deployment, a fin locking mechanism 5 is herein disclosed.

The fins 2 are mounted on crank arms 10 and the crank arms 10 are driven by an actuator assembly 100, which in turn thus drives the fins 2 during deployment.

According to an aspect of the invention, the fin locking mechanism 5 comprises a locking detent 12 which is integral to the crank arm 10, and which has a locking notch 14; a locking plunger 20; an assembly housing 30; a base plate 40; a support plate 50; a rotational loading mechanism 60; and a rotational lock 70.

The locking plunger 20 is spring loaded, and has a first end 22 and an opposing second end 24. The second end 24 is of a size and shape to fit into the locking notch 14. The locking plunger first end 22 is slideably supported on the base plate 40.

The assembly housing 30 has locking plunger channels 32 into which the locking plungers 20 slide. The locking plunger channels 32 are of a size and shape such that when the locking plungers 20 are in the locking plunger channels 32, the locking plunger first end 22 and second end 24 extend out of the locking plunger channels 32. The locking plunger channels 32 act to keep the locking plunger 20 in the desired orientation. Thus in a preferred embodiment of the invention the locking plunger channels 32 have only a slightly larger diameter than the locking plungers 20, and extend to cover all but the locking plunger first end 22 and second end 24. In this embodiment, the locking plungers 20 would preferably be provided with a coating for low sliding friction, such as a Xylan coat.

The base plate 40 is spaced from the locking detent 12 such that when the locking plunger second end 24 is fitted into the locking notch 14, the locking plunger first end 22 is pressed against the base plate 40 by the spring loading, and the locking plunger 20 is relatively perpendicular to the base plate 40. The base plate 40 further has a plurality of locking plunger recesses 42, wherein when the locking plunger first end 22 resides in the locking plunger recesses 42, the locking plunger second end 24 will not reach the locking notch 14 and therefore the fins 2 will be unlocked. The base plate 40 also has a rotation locking recess 44.

The support plate 50 is mounted to the assembly housing 30, and the base plate 40 is rotateably mounted to the support plate 50.

The rotational loading mechanism 60 rotationally loads the base plate 40 to force the base plate 40 to rotate relative to the support plate 50 to a position where the fins 2 are unlocked. When the base plate 40 is rotationally loaded, the rotational lock 70 is extended into the base plate rotational lock recess 44 to lock the base plate 40 into this rotationally loaded position. This is the fin-locked position. In this position, the locking plunger first end 22 is pressed on the base plate 40, and the locking plunger second end 24 is in the locking notch 14. When the rotational lock 70 is released, the base plate 40 rotates such that the locking plunger recesses 42 are under the locking plungers 20. The locking plungers 20 are then forced into the locking plunger recesses 42 by the locking plunger 20 spring loading, thus moving the locking plunger second end 24 out of the locking notch, thus unlocking the fins 2. In a preferred embodiment of the invention, the rotational loading mechanism 60 comprises a spring.

In a preferred embodiment of the invention, the rotational lock 70 comprises a solenoid, wherein the solenoid extends into the base plate rotation locking recess 44. When the solenoid is activated it is retracted from the rotation locking recess 44.

According to an aspect of the invention, the locking plunger first end 22 is slideably supported on the base plate 40 by a ball bearing 26 recessed into the locking plunger first end 22.

According to a further aspect of the invention, the base plate 40 further has a series of circumferential slots 46, wherein the base plate 40 is rotateably mounted to the support plate 50 by a bolt 45 through the circumferential slots 46. The bolt 45 is then threaded to the housing to secure the assembly. In order that the base plate 40 is able to rotate, there is a clearance 48 between the bolts 45 and the circumferential slots 46. Further there are a plurality of ball bearings 55 between the base plate 40 and the support plate 50 to accommodate rotational motion. In a preferred embodiment the support plate 50 has bosses 57 at the bolt locations, wherein the bosses 57 have through holes for the bolts 45. In this embodiment, the bosses 57 protrude through the base plate circumferential slots 46 such that there is a clearance 48 between the bosses 57 and the circumferential slots 46.

In another aspect of the invention, the base plate 40 further has circumferential grooves 49 sized to fit the ball bearings 55, and the support plate 50 has corresponding circumferential grooves 59. According to a further aspect of the invention, the base plate 40 further has circumferential grooves 27 corresponding to the path the locking plunger first end 22 takes when the base plate is rotated. These grooves 27 are to further reduce friction between the base plate 40 and the locking plunger first end 22, and to help guide the locking plunger first end 22 into the locking plunger recesses 42.

The implementation of ball bearings between these plates and on the locking plunger 20 produces low and predictable friction for these moving parts. This allows the use of relatively small forces for the rotational loading to achieve the desired movement of the base plate 40. This in turn allows for the use of a relatively small sized solenoid, requiring low DC power, available from the missile battery.

The entire fin locking mechanism 5 herein described can be assembled in the assembly housing 30, and thus can be installed onto the missile as a one piece unit. This reduces the complexity, and thus cost of production and installation. Prior art systems have required that the fin lock mechanism be installed in the locking position, which requires a precise and more complicated installation. This also meant that in order to lock the fins once they were unlocked, the entire locking assembly would have to be removed and reset. This then does not allow for testing of the unit. Thus a preferred embodiment of the invention allows for re-setting of the locking mechanism after installation. In this embodiment, the assembly housing 30 has a housing manual locking slot 38, and the locking plunger 20 further has a corresponding plunger locking slot 28, for manually placing the locking plunger second end 24 into the locking notch 14. The housing manual locking slot 38 has two portions, a locking portion 37, which is relatively parallel to the locking plunger 20, and a retaining portion 39, which is relatively perpendicular to the locking plunger. Thus a pin 80 inserted into the plunger manual locking slot 28, through the housing manual locking slot locking portion 37, can be used to lift the locking plunger 20 into the locked position, thus placing the locking plunger second end 24 into the locking notch 14. This pin 80 is then moved into the housing manual locking slot retaining portion 39. This will retain the locking plungers 20 in the locking notch 14, and removal of the pin 80 will release the locking plungers 20. Once all of the locking plungers 20 are in the fin-locked position, the base plate 40 may be rotationally loaded, and locked in place with the rotational lock 70. When the base plate 40 has been rotationally loaded and locked, then the pins 80 are removed, allowing the locking plungers to function as intended.

In a preferred embodiment of the invention, the locking plunger second, end 24 may be have a coating for wear resistance, such as a Tungsten Carbide coating.

A method for locking fins 2 and subsequently unlocking fins 2, on a missile 1 having a plurality of otherwise moveable fins 2, is also disclosed. Prior art methods have focused on locking the fin 2 itself, usually with some sort of pin extending into the fin to prevent fin movement, This is done to keep the fin 2 from transferring aerodynamic loads and vibrations to the fin driving mechanism, potentially causing fatigue or failure. According to an aspect of the present invention the driving mechanism itself is locked by locking the crank arm 10 by a crank locking mechanism 6, which in turn then locks the fins 2. The fins are then unlocked by releasing the crank locking mechanism 6 when desired. This is done by using the apparatus as described above.

The locking plungers 20 are spring loaded, and lifted into the locking notch 14. The base plate 40 is rotated to a 'fin-locked' position where the locking plungers 20 will remain in the locking notches 14, and then the base plate is rotationally loaded sufficiently, such that it will rotate to a 'fin-unlocked' (locking plunger recesses 42 underneath locking plungers 20) position if released. The rotationally loaded base plate 40 is then locked into this position by a rotational locking mechanism 60.

According to a further aspect of the invention, a fin control section assembly 200, for controlling missile fins and mounting directly onto a missile, comprises a fin actuator/driving assembly 100, and a fin locking assembly 5. The fin locking assembly 5 is a unit such that the fin locking assembly 5 may be mounted to the fin actuator/driving assembly 100 in one piece such that the fin locking assembly/fin actuator and driving assembly combination may be mounted to the missile as one piece, and further wherein the fins may be locked after mounting of the fin control section assembly to the missile. Prior art required the fins to be locked before the fin locking mechanism was mounted onto the missile. The fin locking assembly 5 may be comprised as described above.

We claim:

1. A method for locking fins and subsequently unlocking fins, on a missile having a plurality of otherwise moveable fins, wherein said fin movement is controlled by a crank arm, which is in turn controlled by an actuator, comprising;

locking said crank arm to prevent rotation in any direction by a crank locking mechanism external to said actuator, releasing said crank locking mechanism when desired upon firing said missile or during free missile flight.

2. The method of claim 1 wherein said crank arm has a locking detent integral to said crank arm, wherein said crank locking mechanism comprises a housing holding a locking plunger wherein said locking plunger is extended into said locking detent.

3. The method of claim 2 wherein said locking plunger is supported by a base plate.

4. The method of claim 3 wherein said locking plunger is slidably supported by said base plate.

5. A method for locking fin and subsequently unlocking fins, on a missile having a plurality of otherwise moveable fins, wherein said fin movement is controlled by a crank arm, which is in turn controlled by an actuator, comprising:

locking said crank arm by a crank locking mechanism external to said actuator, wherein said crank arm has a locking detent integral to said crank arm, wherein said crank locking mechanism comprises a housing holding a locking plunger wherein said locking plunger is extended into said locking detent, wherein said locking plunger is slidably supported by a base plate by a ball bearing recessed in said locking plunger, releasing said crank locking mechanism when desired.

6. The method of claim 5 wherein said locking plunger has a first end and a second end, wherein said first end is slidably supported by said base plate, and said second end is forced into said locking detent by spring loading on said locking plunger.

7. The method of claim 3, wherein said base plate has a plurality of locking plunger recesses, wherein said base plate is spaced from said locking detent such that when said looking plungers are supported in said locking plunger recesses, said locking plunger does not engage said crank arm locking detents, and when said locking plungers are supported by said base plate other than at said locking plunger recesses, said locking plungers engage said locking detent.

8. The method of claim 7, wherein said locking plunger has a first end and a second end, wherein said first end is slidably supported by said base plate, and said second end is forced into said locking detent by spring loading on said lacking plunger and wherein said locking mechanism further comprises a support plate mounted to said housing, wherein said base plate is rotateably mounted on said support plate.

9. The method of claim 8 wherein the crank locking mechanism is released by rotating said base plate relative to said support plate until said locking plungers are in said locking plunger recesses, thus disengaging said locking plungers from said locking detent.

10. The method of claim 9, wherein said base plate further has a series of circumferential slots, wherein said base plate is rotateably mounted to said support plate by a bolt through said circumferential slots, wherein there is a clearance between said bolts and said circumferential slot, and further wherein said bolt passes through said base plate circumferential slot, and is threaded into said housing, and further wherein there are ball bearings between said plates to accommodate rotational motion.

11. The method of claim 10 wherein said base plate has circumferential grooves sized to fit said ball bearings, and wherein said support plate has corresponding circumferential grooves.

12. The method of claim 8 further comprising:

rotating said base plate to a locking position;

rotationally loading said base plate to return to a fin-unlocked position if released, and;

maintaining said rotational loading by locking the position of said base plate relative to said support plate by a rotational locking mechanism, such that releasing said rotational locking mechanism will release said crank locking mechanism.

13. The method of claim 12 wherein said base plate further comprises a rotation locking recess, wherein said rotational locking mechanism comprises extending a rotational lock into said rotational lock recess.

14. The method of claim 13 wherein said rotational lock comprises a solenoid, which extends Into said rotational locking recess when not activated, and when activated, retracts to allow the rotationally loaded base plate to rotate relative to said support plate, thus allowing said locking plungers to fall into said locking plunger recesses, releasing said crank arm locking detent, thus unlocking the fins.

15. The method of claim 12 wherein said base plate is rotationally loaded by a spring.

16. The method of claim 12 further comprising fin relocking steps, for placing the fins into a locked position once they have already been locked and then unlocked, further comprising the steps:

manually lifting said locking plungers into said locking detents, and holding said locking plungers temporarily in this position using a temporary locking mechanism;

rotating said base plate to a locking position;

rotationally loading said base plate to return to a fin-unlocked position if released;

locking the position of said base plate relative to said support plate in said locking position by a rotational locking mechanism; and releasing said temporary locking mechanisms.

17. The method of claim 16 wherein said temporary locking mechanism comprises a pin, a plunger manual locking slot on said locking plungers, end a housing manual locking slot on said housing, wherein said housing manual locking slot has a locking portion which is relatively parallel to said locking plunger, and a retaining portion, which is relatively perpendicular to said locking plunger, further wherein a pin inserted into said locking plunger manual locking slot through said housing manual locking slot locking portion may be used to manually lift said locking plunger second end into said locking detent, and further wherein said pin may then be moved to said housing manual locking slot retaining portion, wherein said pin will retain said locking plunger in said locking plunger detent until removed, and removal of said pin will release said temporary locking mechanism.

18. A fin locking mechanism for locking in place, and subsequently unlocking fins for installation on a missile having a plurality of otherwise moveable fins extending from an outer surface thereof, wherein the fins are mounted to a crank arm, wherein the crank arms are driven by an actuator assembly, which in turn drives the fins, comprising:

a locking detent integral to said crank arm, wherein said locking detent has a locking notch;

a locking plunger, which is spring loaded, wherein said locking plunger has a first end and an opposing second end, wherein said second end is of a size and shape to fit into said locking notch;

an assembly housing, having locking plunger channels, wherein said locking plungers slide into said locking plunger channels, and wherein said locking plunger channels are of a size and shape such that when said locking plungers are in said locking plunger channels, said locking plunger first end and second end extend out of said locking plunger channels;

a base plate, wherein said locking plunger first end is slideably supported on said base plate, wherein said base plate is spaced from said locking detent such that when said locking plunger second end is fitted into said locking notch, said locking plunger first end is pressed against said base plate by said spring loading, and said locking plunger is relatively perpendicular to said base plate, and further wherein said base plate has a plurality of locking plunger recesses, wherein when said locking plunger first end resides in said locking plunger recesses said locking plunger second end will not reach said locking notch and therefore the fins will be unlocked, further wherein said base plate has a rotation locking recess;

a support plate which is mounted to said assembly housing, wherein said base plate is rotateably mounted to said support plate;

a rotational loading mechanism for rotationally loading said base plate to force said base plate to rotate relative to said support plate to a position where the fins are unlocked;

a rotational lock wherein said base plate rotational position is locked in a rotationally loaded position by extending said rotational lock into said rotational lock recess, wherein when said fins are locked, said locking plunger first end is pressed on said base plate, and when said rotational lock is released, said base plate rotates such that said locking plungers recesses are moved under said locking plungers, and said locking plungers are forced into said locking plunger recesses by said locking plunger spring loading, thus moving said locking plunger second end out of said locking notch, thus unlocking the fins.

19. The fin locking mechanism of claim 18 wherein said locking plunger first end is slideably supported by a ball bearing recessed into said first end.

20. The fin locking mechanism of claim 18 wherein said base plate further has a series of circumferential slots, wherein said base plate is rotateably mounted to said support plate by a bolt through said circumferential slots, wherein there is a clearance between said bolts and said circumferential slot and further by a nut mounted on said bolt, wherein there is a clearance between said nut and said base plate, and further wherein there are a plurality of ball bearings between said base plate and said support plate to accommodate rotational motion.

21. The fin locking mechanism of claim 20 wherein said base plate further has circumferential grooves sized to fit said ball bearings, and wherein said support plate has corresponding circumferential grooves.

22. The fin locking mechanism of claim 18 wherein said rotational lock comprises a solenoid, wherein said solenoid extends into said base plate rotation locking recess, such that when said solenoid extends into said rotation locking recess, said base plate does not rotate relative to said support plate, and when said solenoid is activated and retracted from said rotation locking recess, said base plate rotates in the direction of the rotational loading relative to the support plate.

23. The fin locking mechanism of claim 18 wherein said rotational loading mechanism comprises a spring.

24. The fin locking mechanism of claim 18 wherein said locking plunger further has a plunger locking slot, and said assembly housing has a corresponding housing manual locking slot, wherein said housing manual locking slot has a locking portion, which is relatively parallel to said locking plunger, and a retaining portion, which is relatively perpendicular to said locking plunger, further wherein a pin inserted into said locking plunger manual locking slot through said housing manual locking slot locking portion may be used to manually lift said locking plunger second end into said locking detent, and further wherein said pin may then be moved to said housing manual locking slot retaining portion, wherein said pin will retain said locking plunger in said locking plunger detent until removed, and removal of said pin will release said locking plungers, such that said locking plungers can be placed in their locked position after installation of said fin locking mechanism on a missile.

25. A fin control section assembly, for control of missile fins, for mounting directly onto a missile, comprising:

a fin actuator and driving assembly; and, a fin locking assembly, wherein said fin locking assembly is a unit such that said fin locking assembly may be mounted to said fin actuator assembly in one piece such that said fin locking assembly/fin actuator and driving assembly combination may be mounted to the missile as one piece, and further wherein the fins may be locked after mounting of said fin control section assembly to said missile, wherein the fins are mounted to a crank arm, wherein the crank arms are driven by said fin actuator and driving assembly, which in turn drives the fins, wherein said fin locking assembly comprises:

a locking detent integral to the crank arm, wherein said locking detent has a locking notch;

a locking plunger, which is spring loaded, wherein said locking plunger has a first end and an opposing second end, wherein said second end is of a size and shape to fit into said locking notch;

an assembly housing, having locking plunger channels, wherein said locking plungers slide into said locking plunger channels, and wherein said locking plunger channels are of a size and shape such that when said locking plungers are in said looking plunger channels, said locking plunger first end and second end extend out of said locking plunger channels;

a base plate, wherein said locking plunger first end is slideably supported on said base plate, wherein said base plate is spaced from said locking detent such that when said looking plunger second end is fitted into said locking notch, said locking plunger first end is pressed against said base plate by said spring loading, and said locking plunger is relatively perpendicular to said base plate, and further wherein said base plate has a plurality of locking plunger recesses, wherein when said locking plunger first end resides in said locking plunger recesses said locking plunger second end will not reach said locking notch and therefore the fins will be unlocked, further wherein said base plate has a rotation locking recess;

a support plate which is mounted to said assembly housing, wherein said base plate is rotateably mounted to said support plate;

a rotational loading mechanism for rotationally loading said base plate to force said base plate to rotate relative to said support plate to a position where the fins are unlocked;

a rotational lock wherein said base plate rotational position is locked in a rotationally loaded position by extending said rotational lock into said roalational lock recess, wherein when said fins are locked, said locking plunger first end is pressed on said base plate, and when said rotational lock is released, said base plate rotates such that said looking plungers recesses are moved under said locking plungers, end said locking plungers are forced into said locking plunger recesses by said locking plunger spring loading, thus moving said locking plunger second end out of said locking notch, thus unlocking the fins.

* * * * *